US007231800B2

(12) United States Patent
Kappali

(10) Patent No.: US 7,231,800 B2
(45) Date of Patent: Jun. 19, 2007

(54) METHOD FOR FABRICATING AN EXTERIOR PART OF A CAMERA

(75) Inventor: Basavaraj-Rajashekhar Kappali, Singapore (SG)

(73) Assignee: Hewlett-Packard Deveopment Company, L.P., Houston, TX (US)

( * ) Notice: Subject to any disclaimer, the term of this patent is extended or adjusted under 35 U.S.C. 154(b) by 245 days.

(21) Appl. No.: 11/148,675

(22) Filed: Jun. 9, 2005

(65) Prior Publication Data

US 2006/0277964 A1 Dec. 14, 2006

(51) Int. Cl.

| | |
|---|---|
| ***B21D 31/00*** | (2006.01) |
| ***B21D 37/00*** | (2006.01) |
| ***B21B 45/00*** | (2006.01) |
| ***B29C 45/00*** | (2006.01) |

(52) U.S. Cl. ..... 72/379.2; 72/46; 72/412; 264/295

(58) Field of Classification Search ..... 72/412, 72/414, 416, 46, 379.2; 396/540, 535; 264/295, 264/320

See application file for complete search history.

(56) References Cited

U.S. PATENT DOCUMENTS

| | | | | |
|---|---|---|---|---|
| 3,519,162 | A * | 7/1970 | Peterson et al. | 396/535 |
| 3,691,925 | A | 9/1972 | Shinkle | |
| 3,857,270 | A * | 12/1974 | Iten | 72/379.2 |
| 3,881,338 | A * | 5/1975 | Tischuk | 72/46 |
| 4,104,623 | A | 8/1978 | Sloop | |
| 4,225,553 | A * | 9/1980 | Hirota et al. | 264/320 |
| 4,255,036 | A | 3/1981 | Pincetich | |
| 4,259,000 | A | 3/1981 | Heredia | |
| 4,329,041 | A | 5/1982 | Madge et al. | |
| 4,918,477 | A | 4/1990 | Matsuda et al. | |
| 4,980,708 | A | 12/1990 | Leonard | |
| 5,227,822 | A | 7/1993 | Takahashi et al. | |
| 5,343,263 | A | 8/1994 | Takemae et al. | |
| 5,623,712 | A | 4/1997 | Onda et al. | |
| 5,636,409 | A | 6/1997 | Akins | |
| 5,708,898 | A * | 1/1998 | Manabe et al. | 396/535 |
| D392,659 | S | 3/1998 | Takano | |
| 5,907,721 | A | 5/1999 | Schelling et al. | |
| 5,943,899 | A * | 8/1999 | Jung | 72/379.2 |
| 5,946,513 | A | 8/1999 | Lavine et al. | |
| 6,151,453 | A | 11/2000 | Ito | |
| 6,157,788 | A | 12/2000 | Sugita et al. | |
| 6,374,052 | B1 | 4/2002 | Satoh et al. | |
| 6,384,863 | B1 | 5/2002 | Bronson | |
| 6,453,122 | B1 | 9/2002 | Misawa et al. | |
| 6,496,659 | B2 * | 12/2002 | Nagata | 396/535 |

(Continued)

*Primary Examiner*—Derris H. Banks
*Assistant Examiner*—Teresa M. Bonk

(57) ABSTRACT

A method of fabricating an exterior part of a camera is disclosed. The exterior part has an arcuate recess for finger gripping during photography and an arcuately bent portion. The method of fabricating the exterior part includes laminating a plastic protective layer to a surface of a substantially flat stainless steel sheet. An arcuate recess is then formed in the laminated sheet to create a finger grip area. Next, a peripheral flange is formed along a part of the periphery of the sheet, leaving an end portion of the sheet unflanged. The unflanged end portion is manually bent to form an arcuately curved portion with a preliminary curvature. A press die is used to impart a sharper curvature to the curved surface and to perform flanging on the unflanged end portion so as to extend the existing flange along the periphery of the sheet. The extended flange is then ironed to remove any wrinkle.

11 Claims, 9 Drawing Sheets

U.S. PATENT DOCUMENTS 6,640,058 B2 10/2003 Yokomae et al.
6,790,536 B2 * 9/2004 Schonleber et al. ..... 72/379.2
6,826,367 B2 11/2004 Ichikawa et al.
2003/0029216 A1 * 2/2003 Carlsson et al. ..... 72/342.1

* cited by examiner

METHOD FOR FABRICATING AN EXTERIOR PART OF A CAMERA

RELATED APPLICATION

This application is related to and commonly assigned U.S. patent application Ser. No. 10/970,496 filed on Oct. 21, 2004.

FIELD OF THE INVENTION

The present invention relates generally to the field of camera manufacturing.

BACKGROUND

Traditionally, plastics have been used to form exterior casing parts of cameras, e.g. front covers and rear covers. Plastics provide the flexibility for manufacturing parts with complicated three-dimensional shapes. However, plastic exterior parts give the cameras a fragile and low-quality appearance. Recently, some cameras are constructed such that an exterior member, e.g. front cover, is made of metal in order to add a high-quality impression to the cameras. Aluminum has been the preferred material for exterior parts because of its ductility. Furthermore, aluminum can be easily anodized and textured to produce a variety of colors and textures. Although aluminum has its advantages, there exists a need for a method of fabricating cameras' exterior parts using another metal with higher strength, and to give a different look and feel to the cameras.

SUMMARY

The present invention provides a method for fabricating an exterior part of a camera using stainless steel. The exterior part has an arcuate recess for finger gripping during photography and an arcuately bent portion. The method of fabricating the exterior part includes laminating a plastic protective layer to a surface of a substantially flat stainless steel sheet. An arcuate recess is then formed in the laminated sheet to create a finger grip area. Next, a peripheral flange is formed along a part of the periphery of the sheet, leaving an end portion of the sheet unflanged. The unflanged end portion is manually bent to form an arcuately curved surface with a preliminary curvature. A press die is used to impart a sharper curvature to the curved surface and to perform flanging on the unflanged end portion so as to extend the existing flange along the periphery of the sheet. The extended flange is then ironed to remove any wrinkle.

The advantages and features of the present invention will become apparent from the detailed description when read in conjunction with the drawings.

DETAILED DESCRIPTION

Figure 1:
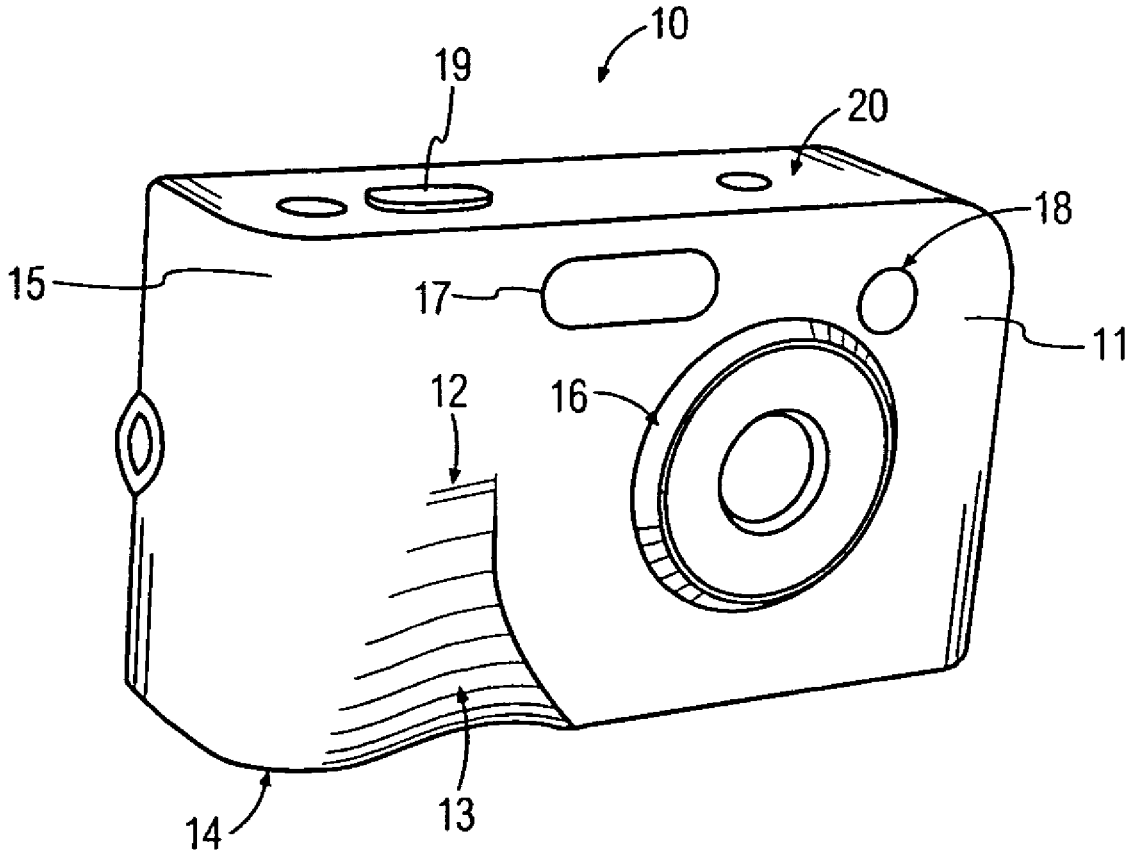
FIG. 1 is a perspective view of a camera according to one embodiment of the present invention.

FIG. 1 illustrates an exemplary hand-held camera 10 having a front cover 11 made of stainless steel. The front cover 11 is provided with a finger grip area 12 for gripping and steadying the camera during photography. The finger grip area 12 includes an arcuate recess 13 that is shaped so as to accommodate a user's finger (e.g. the middle finger). The front cover 11 also includes an arcuately curved portion 14 adjacent to the finger grip area. The arcuately curved portion 14 defines a smooth and curved surface 15 for accommodating the user's palm during gripping. The camera 10 further includes a lens assembly 16, a flash device 17 and a view finder window 18. A shutter release button 19 is located on a top portion 20 of the camera and near the curved portion 14. Stainless steel provides the front cover 11 with a smooth front surface that is wear resistant, sturdy looking, and visually appealing.

Figure 2:
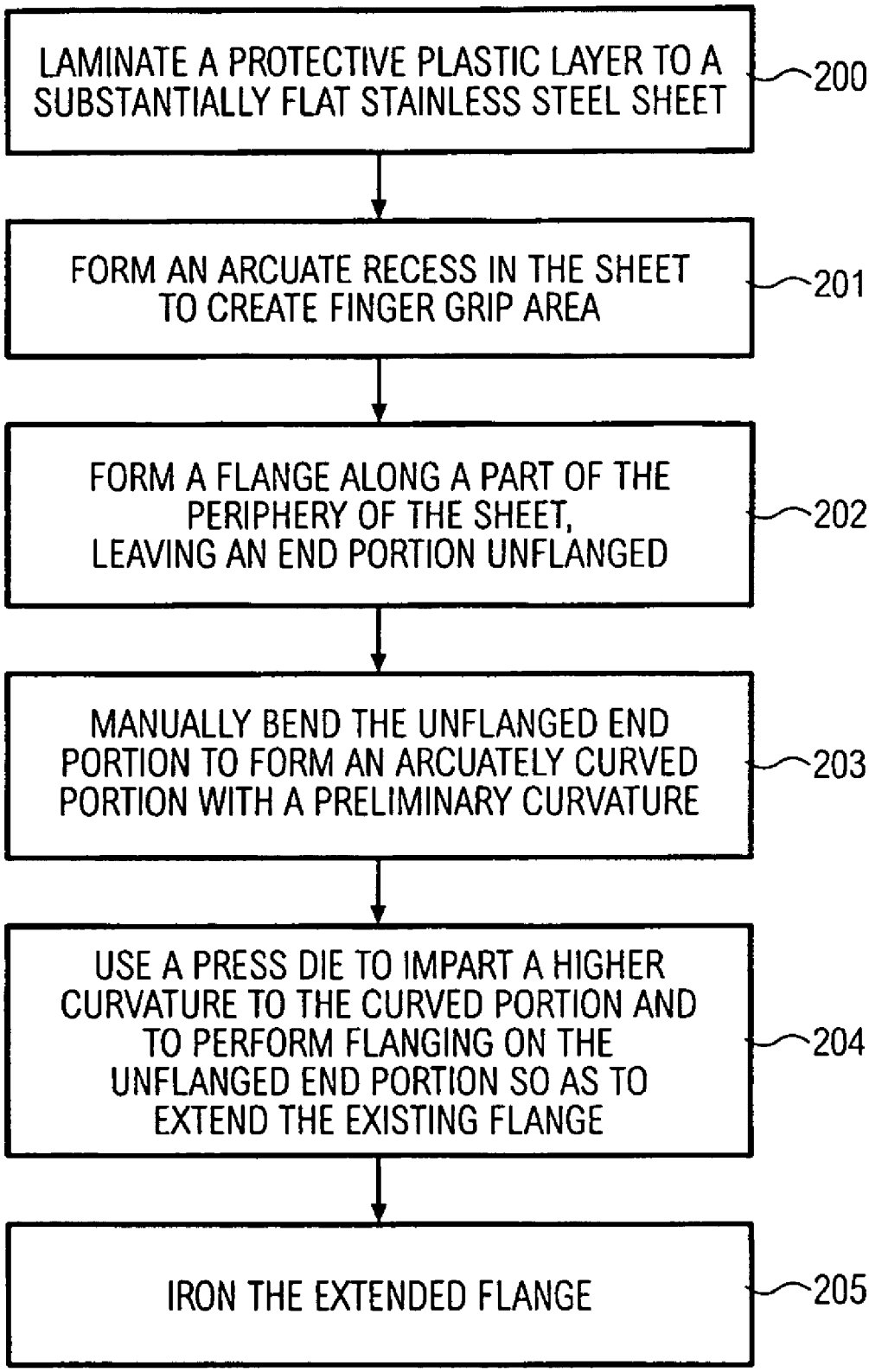
FIG. 2 is a flowchart illustrating a method of fabricating the front cover of the camera shown in FIG. 1 according to an embodiment of the present invention.

According to one embodiment, a method of fabricating the front cover 11 shown in FIG. 1 is illustrated by the flowchart in FIG. 2. At block 200, a protective plastic layer is laminated to a substantially flat stainless steel sheet. At block 201, an arcuate recess is formed in the steel sheet to create a finger grip area. At block 202, a peripheral flange is formed along a part of the outer periphery of the steel sheet, leaving an end portion of the steel sheet unflanged. The unflanged end portion of the steel sheet is manually bent, at block 203, to form an arcuately curved portion with a preliminary curvature. Next, at block 204, a press die is used to impart a higher curvature to the arcuately curved portion and to perform flanging on the unflanged end portion so as to extend the existing peripheral flange along the periphery of the steel sheet. The extended flange is then ironed at block 205 to remove any wrinkle.

Figure 3:
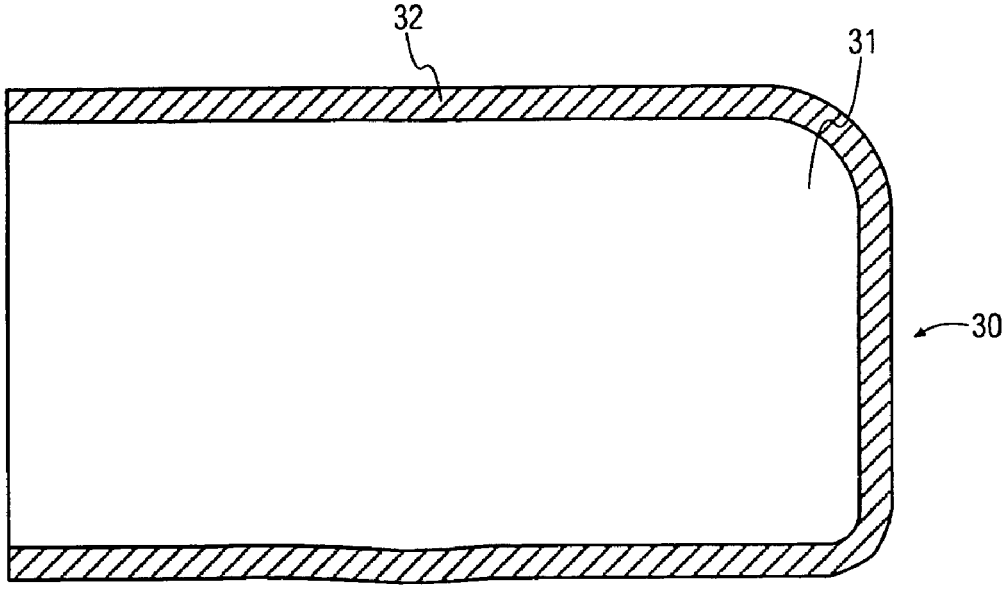
FIG. 3 is a top plan view showing a stainless steel blank to be used for forming the front cover.

A more detailed embodiment of the method of fabricating the front cover will now be described. Referring to FIG. 3, a substantially flat stainless steel blank 30 is provided. The stainless steel blank 30 is substantially rectangular in shape and has a thickness that enables the sheet to be readily shaped to form the complicated curved surfaces of the front cover. However, the blank should not be too thin so as to be readily damaged during metal processing. As an example, the thickness may be from about 0.3 mm to about 0.5 mm. The stainless steel blank may have a hairline surface finish on the front surface. The hairline surface finish may be formed by mechanically brushing or polishing the stainless steel surface. A protective plastic layer 31 is laminated to the front surface of the stainless steel blank, which will be the outer surface of the front cover. The plastic layer 31 is sized so that a narrow peripheral region 32 along three edges of the sheet (hatched area) is exposed. In one embodiment, the stainless steel blank is laminated to a protective plastic layer of larger size. Then the plastic material along the periphery of the blank is removed as indicated by the hatched area. The plastic layer will mitigate damage to the front surface (e.g. dents and scratches) that can occur during the subsequent metal processing steps. An example of a suitable plastic material is a clear polyethylene tape having a thickness of about 0.04 mm to about 0.1 mm.

Figure 4:
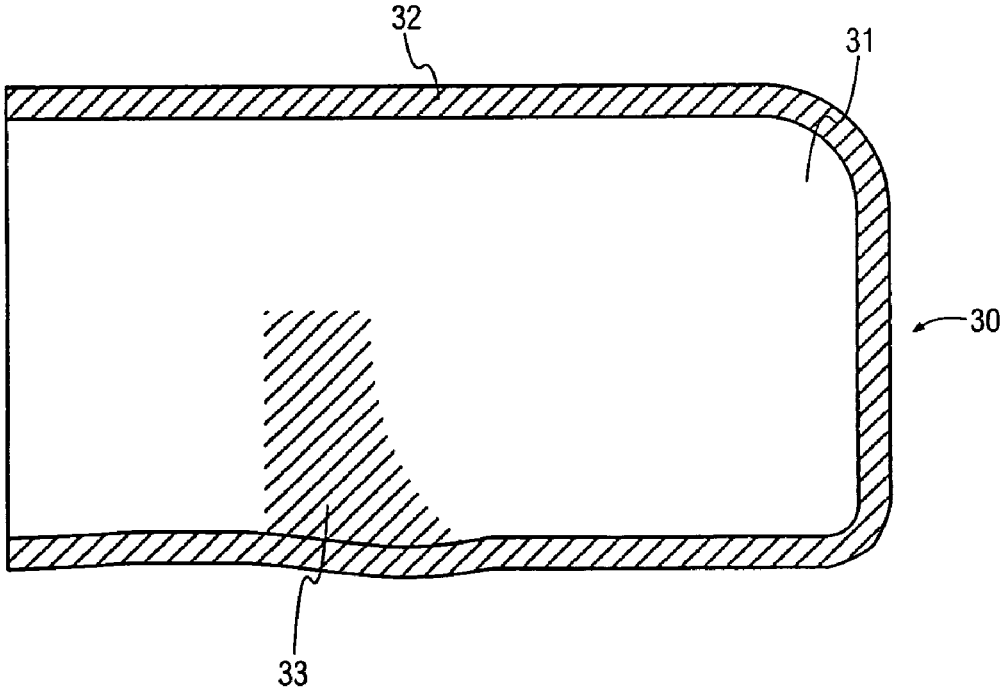
FIG. 4 is a top plan view showing the steel blank with an arcuate recess formed therein.
Figure 5:
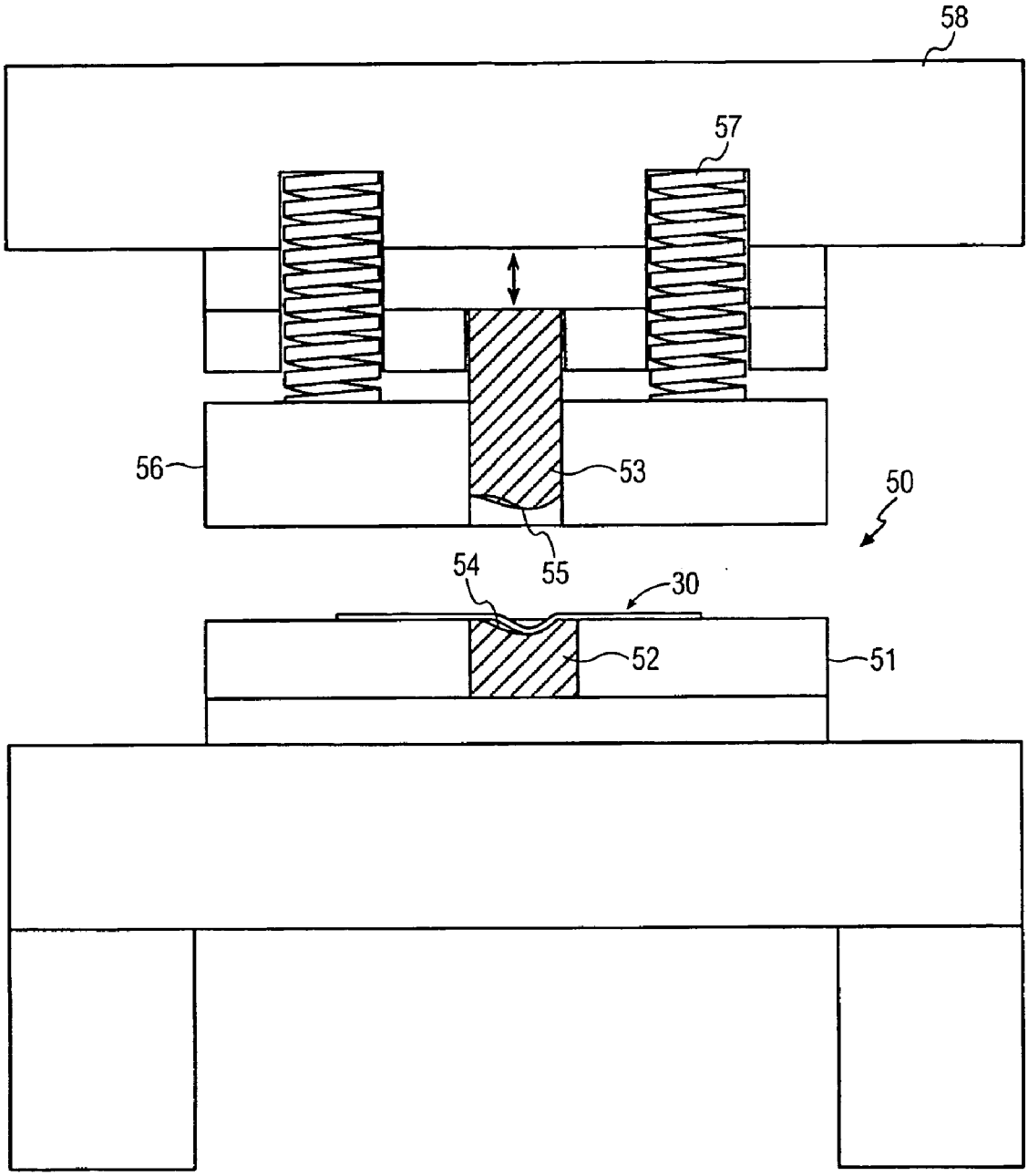
FIG. 5 is a cross-sectional view of an exemplary die set for forming the arcuate recess.

Referring to FIG. 4, an arcuate recess 33 is formed in the stainless steel blank 30 using a die set. The arcuate recess 33 concaves downwards from the front surface of the blank, the front surface being protected by the plastic layer 31. FIG. 5 shows an embodiment of a die set 50 that can be used to form the arcuate recess 33. Referring to FIG. 5, the die set 50 includes a die holder 51 with a die insert 52, a stripper plate 56, and a movable punch 53. The die insert 52 has a recess 54 that defines the arcuate recess of the front cover and the punch 53 has a convex surface 55 that mates with the recess 54 when the die set is closed. The punch 53 is movable into pressing engagement with and away from the die insert 52. When the die set is closed with the steel blank inserted therein, the stripper plate 56 presses the blank against the die holder 51 and the punch 53 moves towards the die insert 52 to cause stamping of the steel blank, thereby duplicating the profile of the punch and die onto the blank surface. The two springs 57, which are symmetrically placed on the stripper plate 56 and connected to the top platen 58, exert a predetermined force on the blank when the die is closed. A minimum stripper force is required to hold the blank properly so as to produce the desired profile in the blank. It will be understood by those skilled in the art that, by changing the number of springs, spring diameter, and spring coil thickness, the stripper force can be varied.

In order to facilitate the formation of the arcuate recess in the steel blank, a lubricant may be applied over the laminated surface of the steel blank before stamping by the punch 53. The lubricant acts as a cushion and spreads the load from the punch or die uniformly over the entire steel blank during stamping. As an example, a suitable lubricant may contain a highly stabilized anti-rust additive in an amount of about 3% by volume, a lubricity additive in an amount of about 20% by volume, chlorine in an amount of about 15% by volume, with mineral oil making up the balance. A lubricant under the trademark name Molychem 721 has been found to be suitable, but it will be understood by those skilled in the art that other metal lubricants may also be used.

Figure 6:
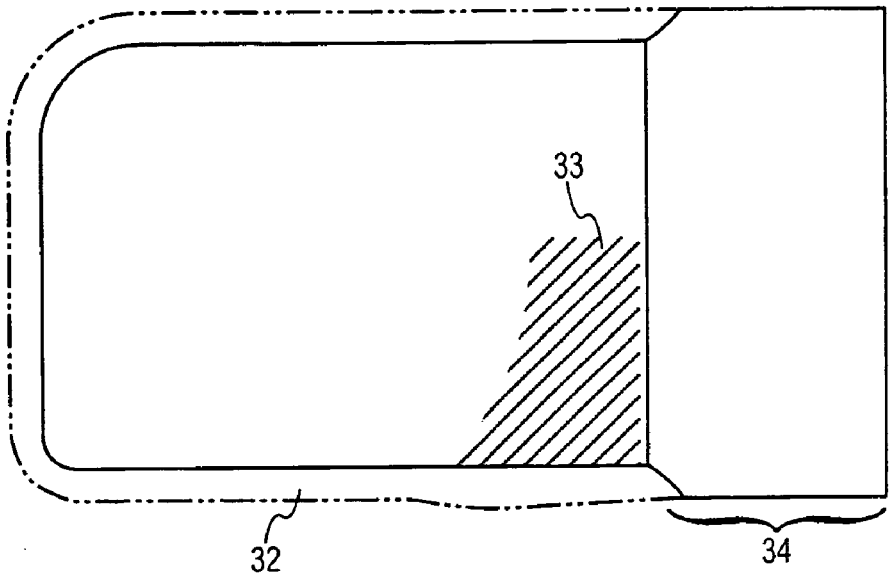
FIG. 6 is a top plan view showing the steel blank after a flange has been formed along a part of the periphery of the steel blank.
Figure 7:
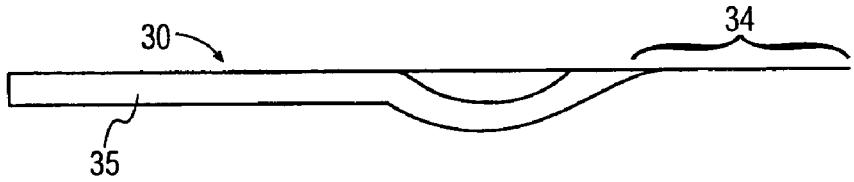
FIG. 7 is a side view of the steel blank shown in FIG. 6.

Referring to FIG. 6, after the arcuate recess 33 has been formed, a flange is formed along a part of the periphery of the blank 30 by folding the narrow peripheral region 32, leaving an end portion 34 unflanged. The arcuate recess 33 is positioned in the flanged portion of the blank and is adjacent to the unflanged portion 34. FIG. 7 shows a side view of the blank 30 after the flange 35 has been formed.

Figure 8:
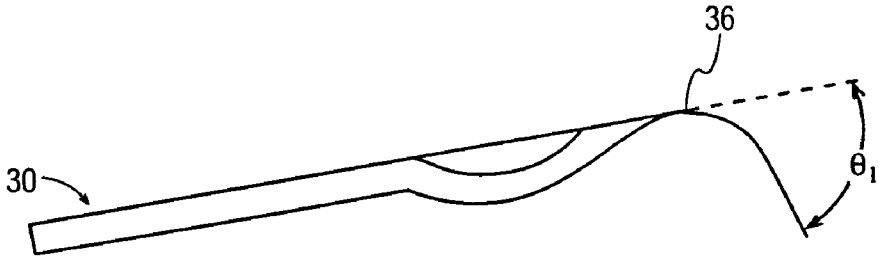
FIG. 8 is a side view of the steel blank after arcuate bending by manual pressing.

Next, the unflanged end portion 34 is arcuately bent by hand pressing to form a curved portion 36 with a preliminary curvature as shown in FIG. 8. In one embodiment, the degree of bending is such that the distal end surface of the bent portion lies in a plane that forms an angle $\theta_1$ of less than 90° with the plane of the unbent portion, e.g., between about 75° to about 82°.

Figure 9:
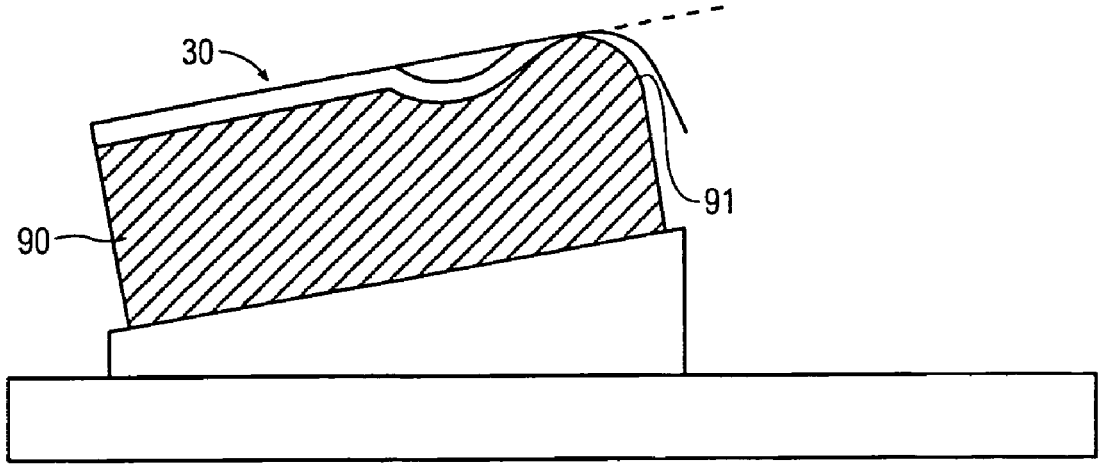
FIG. 9 schematically shows an exemplary platform for supporting the steel blank during manual pressing.

Referring to FIG. 9, during the hand pressing operation, the blank 30 is rested on a platform 90 with a curved shoulder 91. The upper surface of the platform 90 has a contoured profile that is similar to that of the front cover to be formed. During hand pressing, the end portion of the blank is manually pressed against the curved shoulder 91 to effect arcuate bending.

Figure 10:
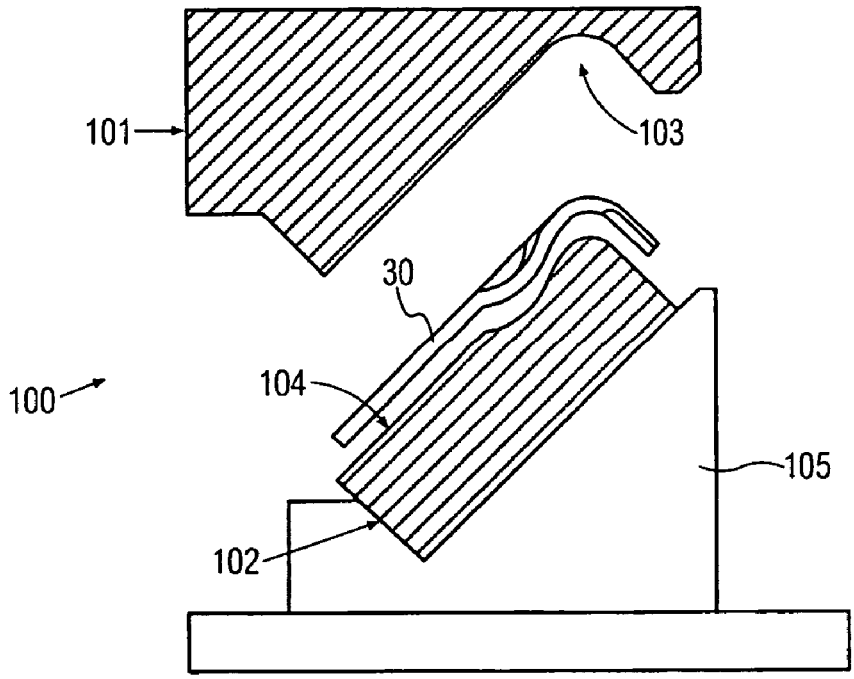
FIG. 10 is a cross-sectional view of an exemplary press die set for press forming the steel blank into the final shape.

Referring to FIG. 10, the bent blank 30 is subjected to further bending and press forming in a press die set 100 to impart a higher curvature to the existing curved portion. The press die set 100 includes a punch 101 and a die 102. The die 102 is supported on a support block 105. The punch 101 is movable into pressing engagement with and away from the die 102. The punch 101 has a contoured cavity 103 that defines the front surface of the front cover. The die 102 has a contoured surface 104, which mates with the contoured cavity 103 of the punch 101 when the die set is closed.

Figure 11:
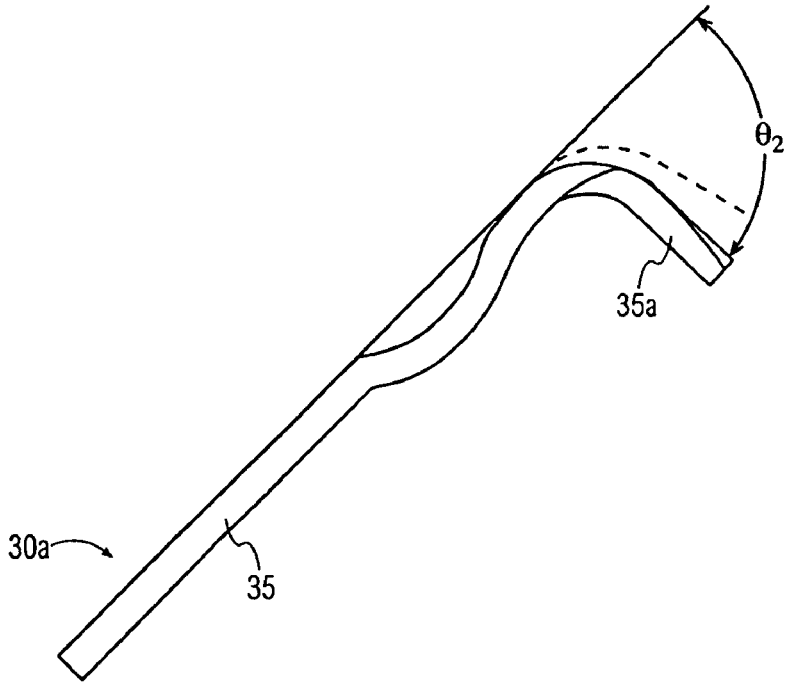
FIG. 11 is a side view of the front cover in its final shape after press forming in the die set of FIG. 10.

As a result of press forming the bent steel blank 30 in the press die set 100, an intermediate front cover 30*a* in its final shape is produced as shown in FIG. 11. The degree of bending caused by the press die set 100 is such that the distal end surface of the bent portion lies in a plane that forms an angle $\theta_2$ of about 90° with the plane of the unbent portion. Referring to FIG. 11, the press die set 100 also performs flanging on the unflanged end portion of the blank so as to form a new flange portion 35*a* along each longitudinal edge of the front cover 30*a*, thereby extending the existing flange 35. As a result, the intermediate front cover 30*a* has a flange surrounding three of its sides, leaving one side unflanged.

Figure 12:
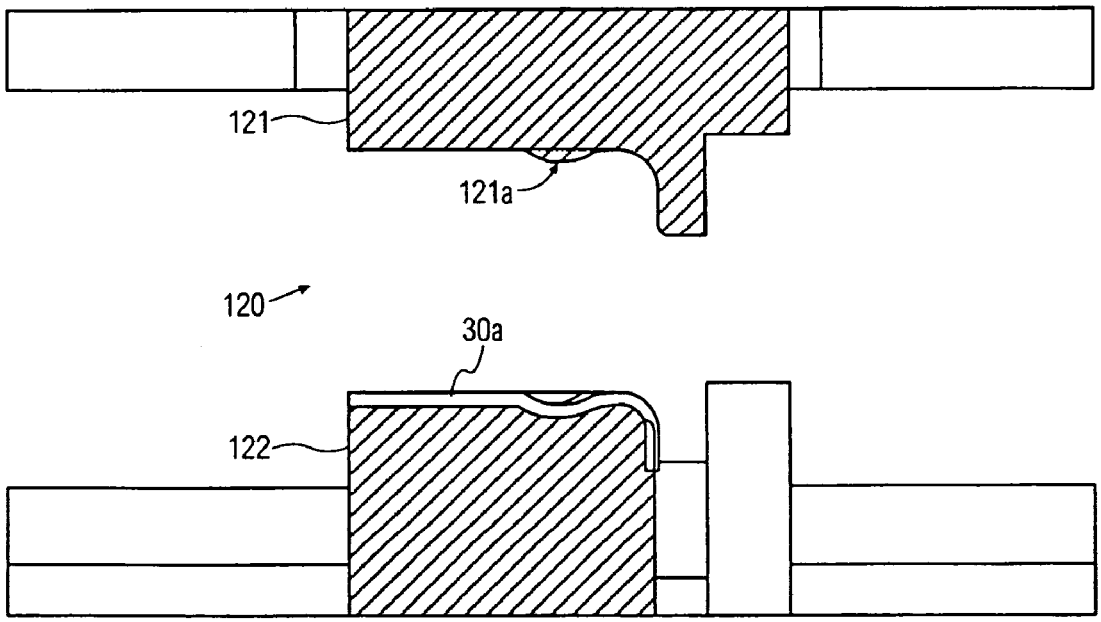
FIG. 12 is a side view of an exemplary tool for ironing the flange.

In the next stage, ironing is carried out to straighten the extended flange 35 and to remove any wrinkle therein. FIG. 12 shows an embodiment of an ironing tool 120 that may be used for the ironing process. The ironing tool 120 includes a punch 121 with a contoured cavity that conforms to the front surface of the front cover and a die 122 with a contoured surface that mates with the contoured cavity of the punch 121 when the punch and the die are in pressing engagement. The punch 121 also has an edge profile 121*a* that is similar to the flange profile of the front cover. This design for the punch 121 reduces the chance of the blank being stuck to punch. Ironing and press forming share the same concept of metal deformation. However, in the case of press forming, the gap between the punch and die is fixed based on factors such as the blank thickness, the amount of burr allowed, the tool material and the blank material. For ironing, in addition to all these factors, the amount of wrinkle needed to be removed is also taken into consideration when deciding the gap distance. Ironing is implemented to smooth out the wrinkles and to force the excess material to flow in different directions. It will be understood by those skilled in the art that more than one ironing step is possible to achieve the required surface finish. Ironing poses additional tool wear problem at those locations where the wrinkles come into contact with the ironing tool. Thus, it is advantageous for the punch and die of the ironing tool to have a surface coating of a wear resistant material. In one embodiment, a tungsten coating is formed on the surfaces of the punch and die to increase the surface hardness of the punch and die and to reduce wearing.

Figure 13:
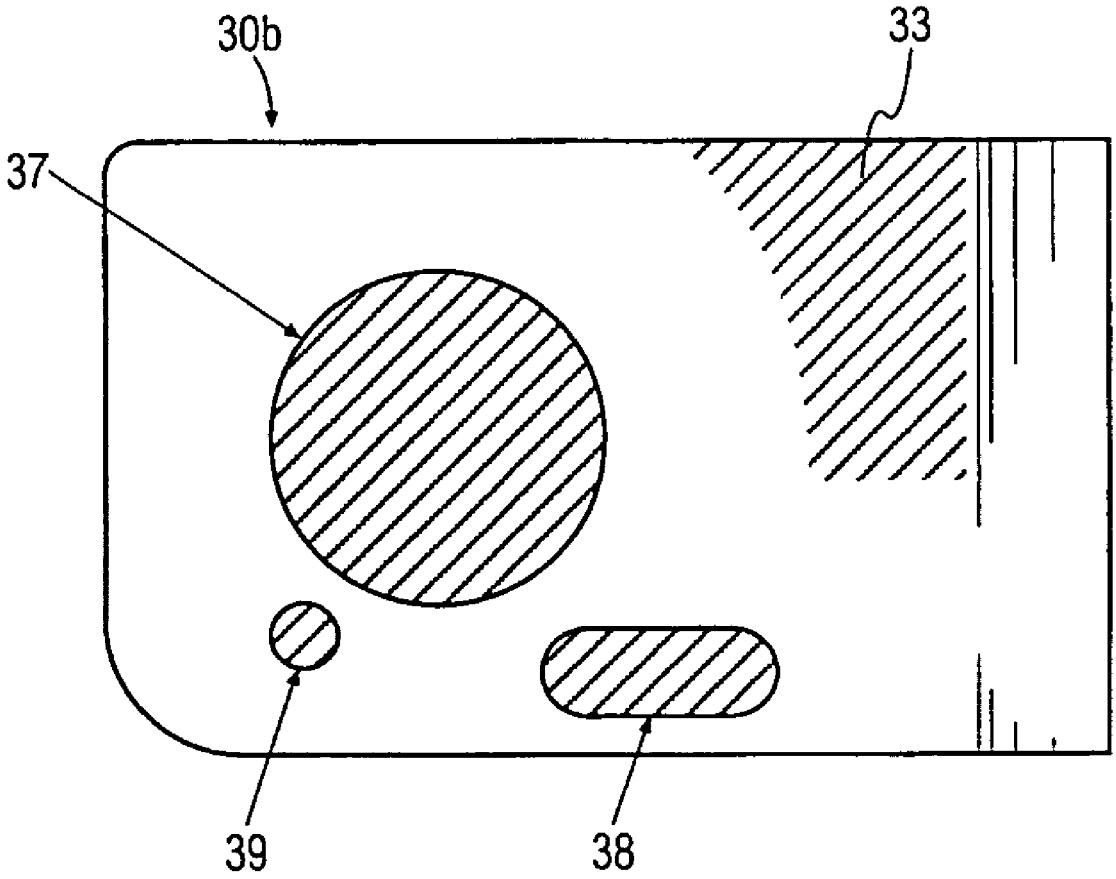
FIG. 13 is a top plan view of the final front cover with apertures for a lens assembly, a view finder window, and a flash.

Referring to FIG. 13, after ironing, openings 37, 38, 39 are pierced through the intermediate front cover 30*a* to produce a final front cover 30*b* with apertures for the lens assembly, the flash device, and the view finder window, respectively.

Figure 14:
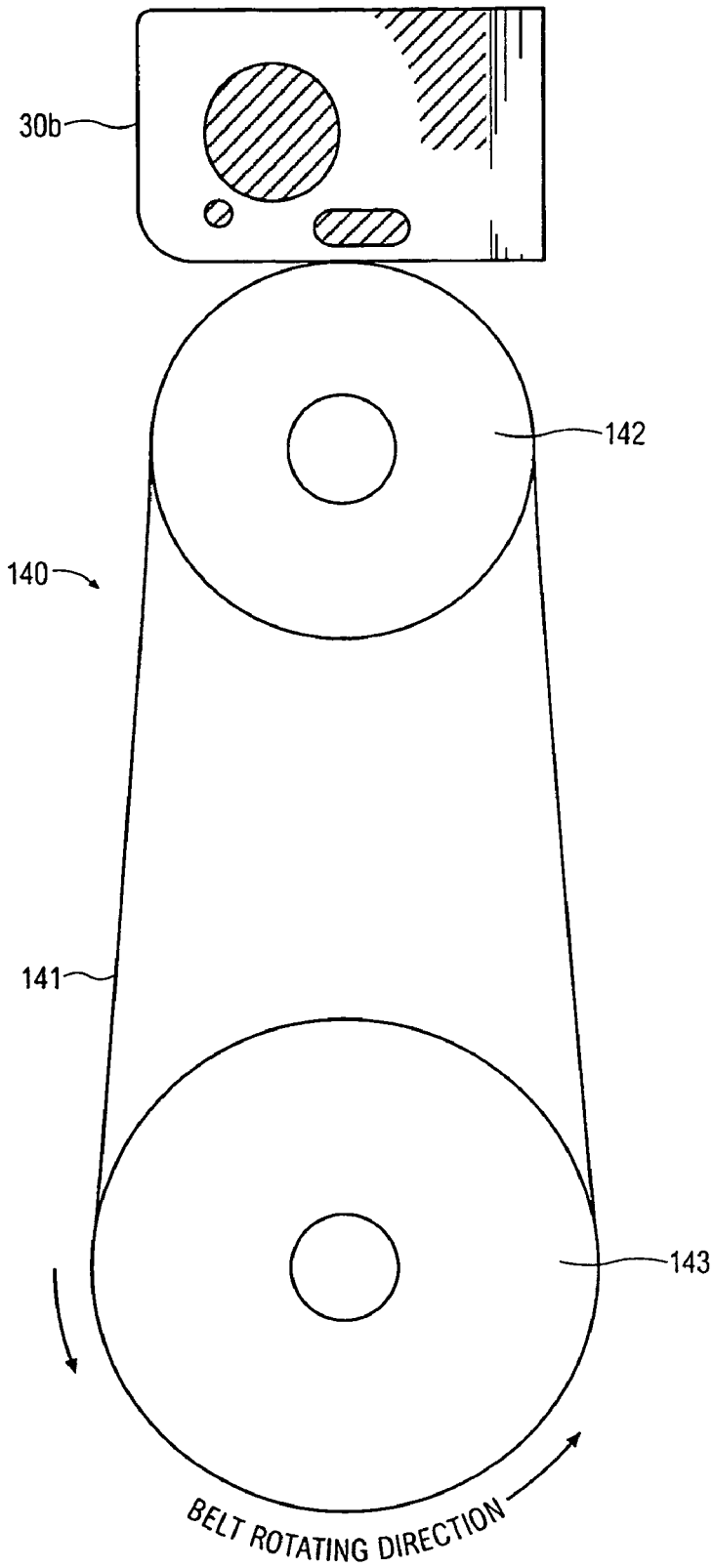
FIG. 14 is a top plan view of an exemplary tool for buffing the flange.

To enhance the appearance of the final front cover 30*b*, the flange may be subjected to buffing in order to match the hairline surface finish of the front surface. FIG. 14 schematically shows an embodiment of a buffing tool 140 that is appropriate for buffing the flange. The buffing tool 140 includes a moving buffing belt 141 that is mounted on two pulleys 142 and 143. The front cover 30*b* is held so that a portion of the flange is urged against the moving belt during buffing as shown in FIG. 14. The front cover is rotated during buffing so that the entire flange can be buffed. Optionally, a suction pump (not shown) is arranged just next to the buffing area to remove the dust particles.

It will be understood by those skilled in the art that the front cover may have three-dimensional contours that are different from those described above and the metal shaping techniques described above would still be applicable.

It is intended that the embodiments contained in the above description and shown in the accompanying drawings are illustrative and not limiting. It will be clear to those skilled in the art that modifications may be made to these embodiments without departing from the scope of the invention as defined by the appended claims.

What is claimed is:

1. A method of fabricating an exterior part of a camera, said method comprising:

providing a substantially flat stainless steel sheet;

laminating a plastic layer to one surface of the sheet;

forming an arcuate recess in the sheet to create a finger grip area;

folding along a part of the periphery of the sheet to form a peripheral flange, leaving an end portion of the sheet unflanged;

manually bending the unflanged end portion to form an arcuately curved portion with a preliminary curvature;

pressing the bent sheet in a press die to impart a sharper curvature to the arcuately curved portion and to perform flanging on the unflanged end portion so as to extend the peripheral flange along the periphery of the sheet; and ironing the extended peripheral flange to remove any wrinkle.

2. The method of claim 1, wherein the exterior part is a front cover.

3. The method of claim 1 further comprising applying a lubricant over the laminated surface of the sheet prior to forming the arcuate recess.

4. The method of claim 2 further comprising:

piercing openings through the bent sheet after press forming in the press die to form apertures for a lens assembly, a flash device, and a view finder window.

5. The method of claim 1 further comprising:

buffing the extended peripheral flange after ironing.

6. The method of claim 1 wherein the plastic layer is transparent.

7. The method of claim 1 wherein the unflanged end portion is pressed against a curved surface during manual bending.

8. The method of claim 1 wherein a distal end surface of the arcuately curved portion formed by manual bending lies in a plane that forms an angle of less than 90° with the plane of an unbent portion of the sheet.

9. The method of claim 7 wherein, after pressing in the die set, the distal end surface of the arcuately curved portion lies in a plane that forms an angle of about 90° with the plane of an unbent portion of the sheet.

10. The method of claim 2 wherein ironing is performed in an ironing tool comprising a punch and a die, the punch having a contoured cavity that conforms to an outside front surface of the front cover and having an edge profile corresponding to the edge profile of the front cover.

11. The method of claim 1 wherein the stainless steel sheet is substantially rectangular in shape.

* * * * *

UNITED STATES PATENT AND TRADEMARK OFFICE

CERTIFICATE OF CORRECTION

PATENT NO. : 7,231,800 B2
APPLICATION NO. : 11/148675
DATED : June 19, 2007
INVENTOR(S) : Basavaraj-Rajashekhar Kappali It is certified that error appears in the above-identified patent and that said Letters Patent is hereby corrected as shown below:

Title page, Item (73), "Assignee", delete "Deveopment" and insert -- Development --, therefor.

Signed and Sealed this

Eighteenth Day of May, 2010

David J. Kappos

David J. Kappos
*Director of the United States Patent and Trademark Office*